US006732651B2

(12) United States Patent
Dziedzic et al.

(10) Patent No.: US 6,732,651 B2
(45) Date of Patent: May 11, 2004

(54) PRINTING PRESS WITH INFRARED DRYER SAFETY SYSTEM

(75) Inventors: John M. Dziedzic, Bartlett, IL (US); Kenneth H. Giesen, Northbrook, IL (US); Erik A. Leman, DeKalb, IL (US)

(73) Assignee: Oxy-Dry Corporation, Itasca, IL (US)

( * ) Notice: Subject to any disclaimer, the term of this patent is extended or adjusted under 35 U.S.C. 154(b) by 0 days.

(21) Appl. No.: 10/104,244

(22) Filed: Mar. 22, 2002

(65) Prior Publication Data

US 2003/0177927 A1 Sep. 25, 2003

(51) Int. Cl.[7] ..... B41F 35/00; F26B 3/34
(52) U.S. Cl. ..... 101/424.1; 34/266
(58) Field of Search ..... 101/424.1, 416.1, 101/484; 34/267, 68, 550, 245, 266; 700/127, 276; 219/343, 388

(56) References Cited

U.S. PATENT DOCUMENTS 4,354,095 A * 10/1982 de Vries ..... 219/388
4,495,713 A * 1/1985 Williner ..... 34/68
4,501,072 A * 2/1985 Jacobi et al. ..... 34/267
4,698,767 A * 10/1987 Wensel et al. ..... 700/127
4,882,992 A * 11/1989 Schmoeger ..... 101/424.1
5,117,562 A * 6/1992 Dulay et al. ..... 34/550
6,026,748 A 2/2000 Reed et al.
6,125,759 A 10/2000 Epps
6,191,430 B1 * 2/2001 Belotserkovsky et al. ..... 250/559.16
2003/0015983 A1 * 1/2003 Montero et al. ..... 318/473

* cited by examiner

*Primary Examiner*—Charles H. Nolan, Jr.
*Assistant Examiner*—Hoai-An D. Nguyen
(74) *Attorney, Agent, or Firm*—Leydig, Voit & Mayer, Ltd.

(57) ABSTRACT

A printing press with an infrared dryer unit is provided with a safety system for detecting overheating and sheet jamming conditions. The safety system has a temperature sensor disposed to directly detect the temperature of a passing printed sheet and to generate an output signal proportional to the detected temperature. As the printed sheets pass by the sensor, the sensor output signal contains a pulse for each passing sheet. A controller monitors temperature readings derived from the output signal of the temperature sensor for identifying a sign of overheating. The controller also determines whether there is an interruption in the flow of sheets by monitoring the pulses in the sensor output signal. In the case the sensor fails to provide pulses for a predetermined time, the controller generates a control signal indicating the detection of an interruption in the sheet flow.

18 Claims, 6 Drawing Sheets

A
A
34
38
36
SHEET FLOW
26
128
30

36a
30
36
SHEET FLOW
40
26
38
34
14
50a
54
50
48
42

PRINTING PRESS WITH INFRARED DRYER SAFETY SYSTEM

FIELD OF THE INVENTION

The present invention generally relates to drying liquid printing substances such as inks, coatings and the like applied to sheet material in a printing press by heating the sheet material as it is moving through the printing press, and more particularly to a safety system for use with printing presses having infrared dryer systems operable at high temperatures for heating and drying the passing sheet material.

BACKGROUND OF THE INVENTION

One of the major concerns associated with the use of printing systems having infrared dryers is that such infrared dryers have high operating temperatures, which can be up to 800–1000° F. If the boards, sheets or other printed substrate material become jammed in the area of the infrared dryer, the heat produced by the infrared dryer can ignite the substrate material and not only cause damage to the printing equipment, but jeopardize the safety of personnel in the surrounding area.

Heretofore, efforts to detect sheet jams and overheating often have required separate monitoring systems which are not wholly effective and which can result in unnecessary shut-down of the printing press. For example, temperature-sensing systems do not necessarily sense a sheet jam prior to an overheating condition, which can result in potential damage to the printing press. Systems that detect sheet travel interruption, i.e., jam, may not sense potential fire conditions and can result in unnecessary shutdown of the press. Prior temperature sensing systems also can be unreliable by detecting only the temperature in the vicinity of the passing sheet material, and not the temperature of the sheet material itself.

OBJECTS AND SUMMARY OF THE INVENTION

It is an object of the present invention to provide a printing press with one or more infrared substrate dryer units having a safety system, which more reliably guards against overheating and fire hazards associated with the high operating temperatures of infrared dryers.

Another object is to provide a printing press as characterized above with a temperature-responsive safety system for sensing the interruption of sheet flow through the printing press and fire hazards associated therewith.

A further object is to provide a printing press having infrared dryer units and a unitary safety system for both sensing the interruption in sheet flow and associated fire hazards.

Still another object is to provide an infrared dryer safety system for printing presses that is relatively simple in construction and operation and which lends itself to easy field retrofitting. More particularly, it is an object to provide such an infrared dryer safety system which utilizes a single sensor for detecting both sheet jams and potential fire hazards caused by the interruption of the flow of sheet material.

Yet another object is to provide an infrared dryer safety system that is more reliable by directly sensing the temperature of passing sheet material.

Other objects and advantages of the invention will become apparent upon reading the following detailed description and upon reference to the drawings, in which:

Figure 1:
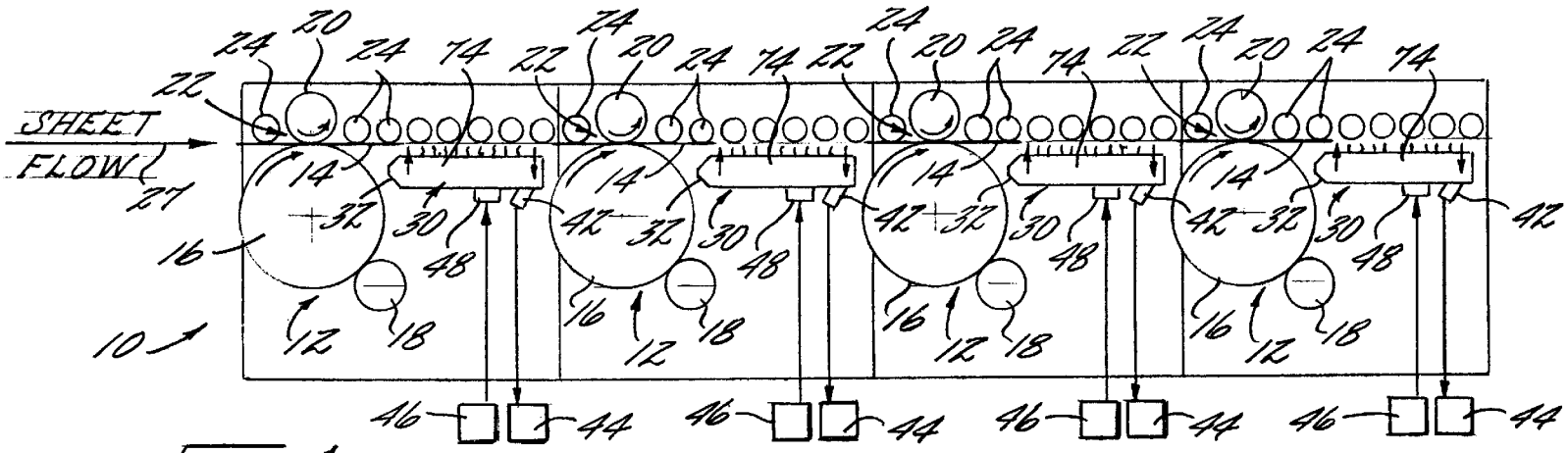
FIG. 1 is a schematic side elevation view of an illustrative in-line printing press with a plurality of laterally spaced printing units and interstation infrared dryers having a safety system in accordance with the present invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to FIG. 1 of the drawings, there is shown an illustrative printing press 10 embodying the present invention which, in this case, is an in-line printing press having a plurality of laterally spaced printing units 12 wherein a liquid printing substance, such as an ink, a coating, or the like, is applied to sheets or substrates 14 of printable material, such as paper, cardboard blanks, and the like. As is customary in the art, each printing unit 12 includes a rotary plate cylinder 16 to which a printing plate is attached, a metering roller 18 which supplies either a specific color of ink or a coating to the plate cylinder 16, and an impression cylinder 20 which cooperates with the plate cylinder 16 to form a nip 22 therebetween. As sheets 14 pass between the upper impression cylinder 20 and the lower plate cylinder 16 of one of the printing units 12, the plate cylinder applies an inked image onto the sheets 14. In multicolor printing operations, a different ink color is applied to the sheets 14 at each printing unit or station 12.

Figure 2:
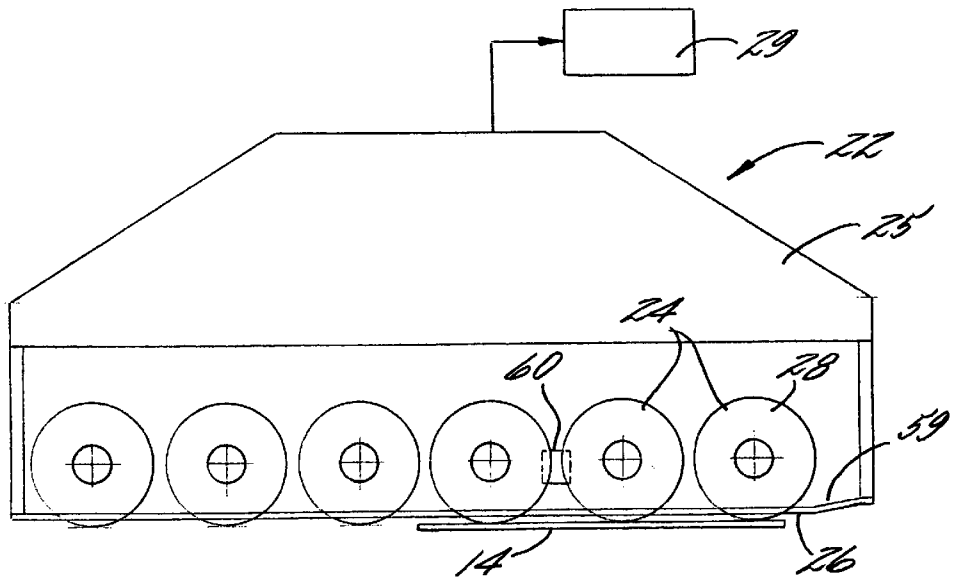
FIG. 2 is an enlarged schematic side elevation view of the sheet transfer system associated with one of the interstation infrared dryers of the illustrative printing press.

For transferring and guiding the sheets 14 between the printing units 12, a sheet transfer system is provided that includes a plurality of aligned transfer rollers 24 arranged within a housing 25 immediately above the row of plate cylinders 16, as depicted in FIGS. 1 and 2. A lower portion of each transfer roller 24 extends through a respective opening in a transfer plate 26 arranged above the plate cylinders 16 and below shafts 28 (FIG. 2) that define the rotational axes of the transfer rollers 24. As is known in the art, when the sheets 14 are traveling between printing units 12 and no longer supported by one of the plate cylinders 16, the sheets are maintained in contact with the transfer plate 26 and transfer rollers 24 by a vacuum applied within the housing 25 by a blower 29, and thereby through the openings in the transfer plate 26, such that the transfer plate 26 defines a sheet-guiding path while rotation of the transfer rollers 24 moves the sheets 14 in the sheet flow direction 27 through the printing unit 12.

Figures 3, 4:
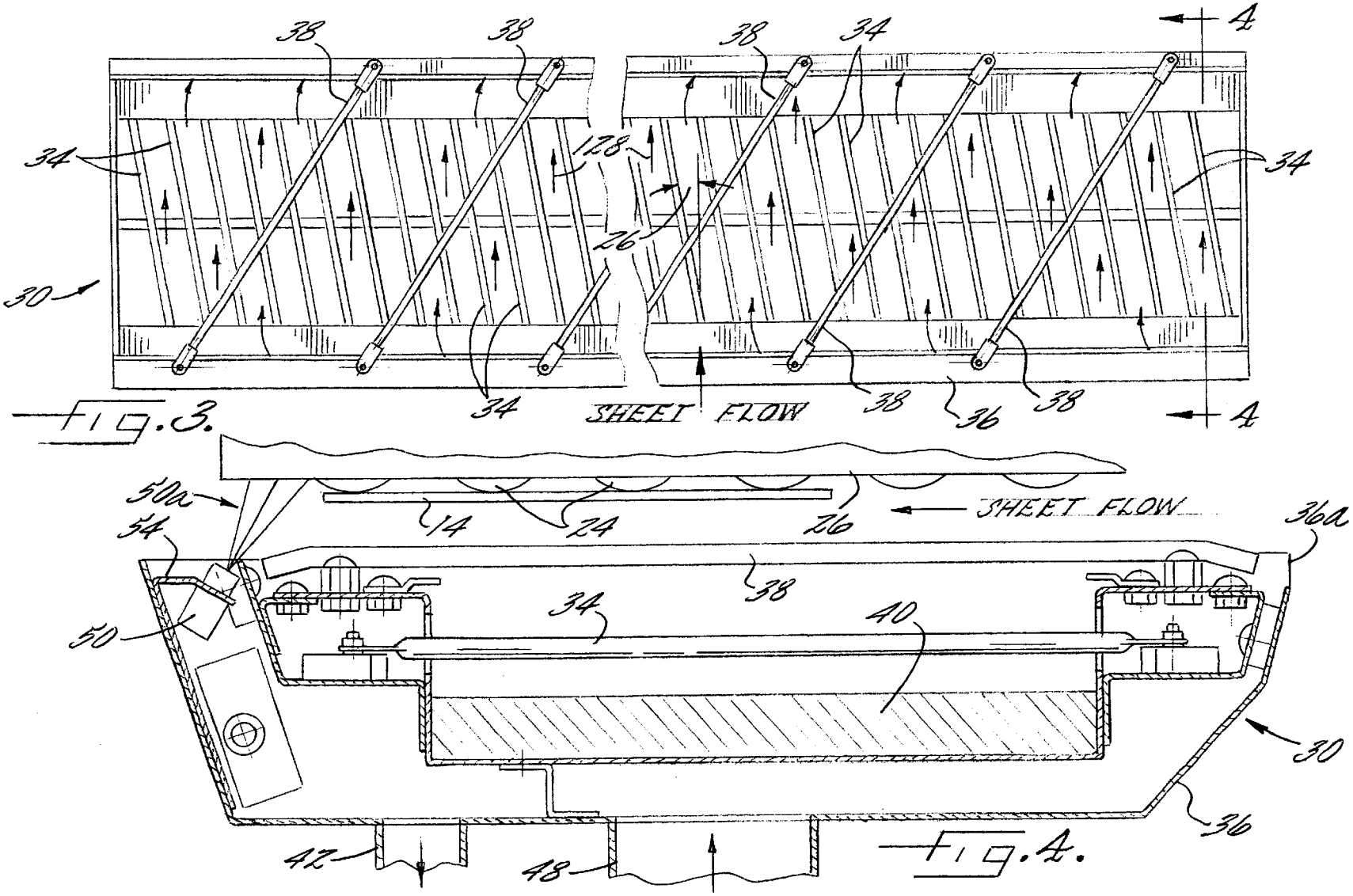
FIG. 3 is a partially fragmentary top plan view of one of the interstation infrared dryer units of the illustrated printing system.
FIG. 4 is an enlarged vertical section view of the interstation infrared dryer unit shown in FIG. 3, taken in the plane of line 4—4.

To quickly and efficiently dry and bond the inks, coatings, and the like on the sheets or substrates 14, even during high-speed operation of the printing press 10, interstation dryer units 30 are interposed between the printing units 12. As illustrated in FIG. 3, each of the interstation dryer units 30 includes a plurality of infrared heating/drying lamps 34 for transmitting infrared (IR) radiation to the moving printed sheets 14. To this end, each interstation dryer unit 30 comprises a housing or cabinet 36 which supports the infrared lamps 34 in relatively close proximity to the moving printed sheets 14. The infrared lamps 34 preferably comprise an alternating series of shortwave and mediumwave infrared lamps which are arranged at an angle to the sheet flow direction 27, as described in U.S. Pat. No. 6,026,748 assigned to the same assignee as the present application, the disclosure of which is incorporated. herein by reference. While the present invention is described in connection with an in-line printing press having interstation infrared dryer units interposed between a plurality of printing units, it will be readily appreciated that the invention is equally applicable to any type of printing press with one or more dryers.

To apply the heating infrared radiation to the printing sheets, the cabinet 36 in this case has a substantially open top portion 36*a*, as shown in FIG. 4, arranged between the moving printing sheets 14 as defined by the sheet flow direction 27, and the short and medium wave infrared lamps 34. In order to protect the lamps 34 from falling sheets and other debris, a plurality of substantially parallel cross members 38 extend across the open top portion 36*a* of the cabinet 36 at an angle with respect to the sheet flow direction, as shown in FIG. 3. A flat ceramic plate 40 (FIG. 4) in this instance is supported in the bottom of the cabinet 36 for blocking downward heat transfer.

During heating and drying of liquid printing substances on the passing printed sheets 14, a significant amount of moisture evaporates causing humidity to build up between the printing units 12. In order to evacuate this moisture-laden air, the dryer cabinet 36 includes at least one exhaust port 42 which is coupled to an communicates with an exhaust or suction blower 44, as shown in FIG. 1. A continuous supply of relatively dehydrated replacement or make-up air from a supply blower 46 is directed into the interior of the dryer cabinet 36 via an inlet port 48. Notwithstanding such air direction, as indicated above, infrared dryer units have relatively high operating temperatures. In the event of a jam up of sheet material over the infrared dryer unit, a potential fire hazard can be quickly created.

Figure 5:
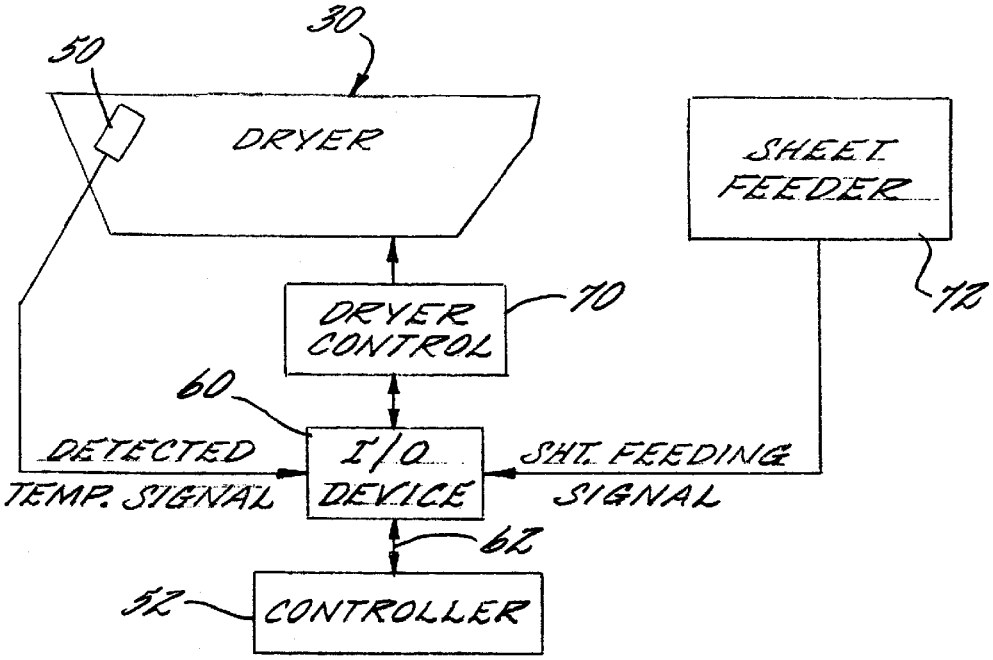
FIG. 5 is a schematic diagram showing components of the safety system for detecting overheating and sheet jam conditions.

In accordance with an important aspect of the invention, the infrared dryer units are equipped with a safety system which is operable for directly sensing the temperature of passing sheet material, and in response thereto, shutting down operation of the printing press, or providing some other output indication, in the event of a jam up or other interruption in the flow of sheet material through the printing press. To this end, each infrared dryer unit 30 includes a temperature sensor 50 arranged for directly sensing the temperature of sheets passing over a respective dryer unit and generating a signal responsive thereto for direction to a controller 52 (FIG. 5). In the illustrated embodiment, a temperature sensor 50 is mounted at the downstream end of each infrared dryer unit 30 and is oriented for sensing the temperature of each sheet exiting the respective infrared dryer unit 30. It will be appreciated by one skilled in the art that the temperature sensor can be easily retrofitted to existing printing presses. One example of a suitable non-contact infrared temperature sensor is a temperature sensor manufactured by Raytek and sold under the tradename THERMALERT Model MID. As is known in the art, such temperature sensors are operable for generating an output amperage signal proportional to the temperature sensed by collecting infrared emitted from the sample within a detection zone of the sensor. Those skilled in the art will appreciate that other types of temperature sensors can be used including contact-type sensors.

The illustrated temperature sensor 50 is mounted on a support bracket 54 of the cabinet 36 slightly below the level of the moving sheets. The temperature sensor 50 in this instance is mounted at an angle of about 45° to the horizontal such that a detection zone 50*a* of the sensor projects upwardly and rearwardly with respect to the sheet flow direction 27 for sensing the temperature of each sheet as it exits infrared heating lamps 34. It will be appreciated by one skilled in the art that during normal operation of the printing press sheets proceed in the flow direction 27 in forwardly and rearwardly spaced relation to each other.

Figure 6A:
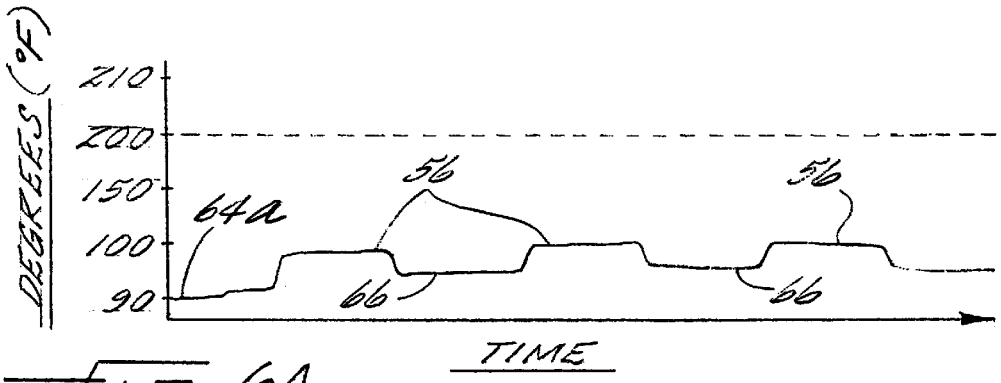
FIG. 6A is a schematic diagram showing a detected temperature curve for a normal operation of the printing press.

As each sheet crosses the detection zone 50*a* of the sensor 50, the temperature of the sheet, which is relatively high having just past the infrared lamps 34, is sensed by the sensor 50 which produces an amperage output signal proportionate to the detected sheet temperature. As the sheet proceeds past the infrared beam 50*a*, the sensor will sense the relatively lower temperature of the space between the moving sheets, i.e., in this case the transfer plate 26, and generate a relatively lower output amperage signal. Hence, during normal operation of the printing press, the sensor 50 will generate a series of relatively high amperage output pulses 56 responsive and proportionate to the temperature of the heated sheets, as depicted by the detected temperature curve 64*a* in FIG. 6A. During normal operation of the printing press, which typically may run between 200 and 250 sheets per minute, the temperature sensor would generate a similar number of high output amperage pulses per minute.

To convert the output amperage signal of the sensor 50 into a digital format that can be processed by the controller 52, an input/output (I/O) device 60, such as an Allen-Bradley FLEX I/O module, is coupled to the sensor to receive the sensor output signal. The I/O device 60 periodically samples the analog amperage output signal of the sensor 50 and converts each sampled signal point into an integer number that is proportional to the temperature detected by the sensor. This integer is then transferred to the controller 52 via an I/O link 62, such as an Allen-Bradley Remote I/O network connection. The sampling of the amperage output signal of the temperature sensor 50 is preferably performed by the I/O device 60 at a suitable frequency, such as once every 50 milliseconds (i.e., 20 times a second), that is selected based on the sheet feeding frequency of the printing press and the transfer speed of the sheets.

In keeping with the invention, the controller 52 is a computing device which may be a stand-along computer or a single-board computer mounted in a control equipment rack, and has appropriate software loaded therein to be operable for monitoring the temperature readings provided by the sensor to detect any overheating problem. Moreover, the controller 52 monitors output pulses from the temperature sensor 50, and in response to the failure to detect an output pulse from the temperature sensor 50 for predetermined period of time, provides an output indication of the interruption in the sheet flow and shuts down operation of the press.

Figure 6B:
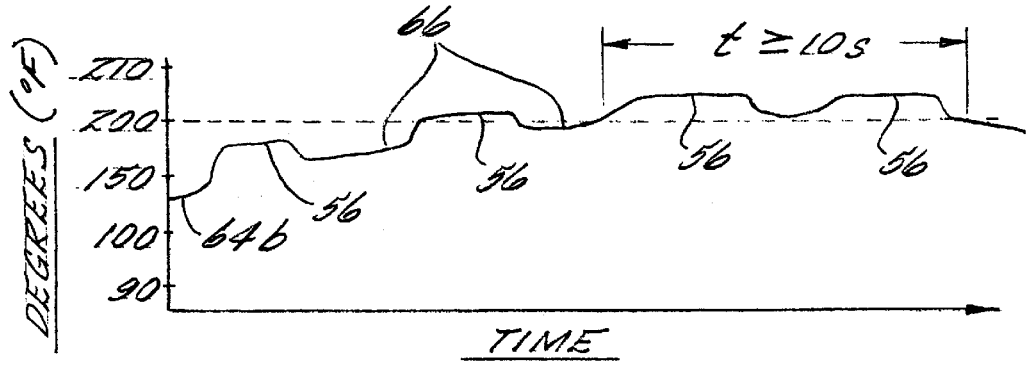
FIG. 6B is a schematic diagram showing a detected temperature curve indicative of an overheating condition.

To detect any overheating condition, the controller constantly monitors the temperature readings it has received from the I/O device. As mentioned above, in a normal operation condition, the sensor detects a relative higher temperature when it is looking at a sheet and a relative lower temperature when it is looking at a space between two sheets. As a result, the detected temperature curve 64*a* includes a train of pulses 56, with each pulse representing temperature readings on a passing sheet and each lower temperature section 66 between the pulses representing temperature readings of the support plate. During the normal operation of the printing press, the temperature pulses are expected not to exceed certain operating temperature. In the case of overheating, however, the detected temperature progressively goes up, as depicted by the detected temperature curve 64*b* in FIG. 6B. If the detected temperature goes above a pre-selected overheating temperature threshold, such as 200° F., for longer than an overheating time threshold, such as 10 seconds, the controller 52 determines that there is an overheating condition. In response, the controller generates an Overheating Detected signal, which is used as a control signal for triggering the dryer control module 70 (FIG. 5) to shut off the infrared heating lamps or, alternatively, to reduce the heating power generated by the infrared lamps.

Besides detecting any overheating condition, the temperature readings provided by the sensor also enables the controller to detect an interruption in the sheet flow. By analyzing the temporal behavior of the temperature readings, the controller 52 is capable of determining different conditions of the flow of the printing sheets: normal, sheet jammed, and sheet not being fed. To synchronize the detection by the controller with the feeding of the sheet material into the printing unit, the controller 52 also receives through the I/O device a sheet-feeding signal generated by a sheet feeder 72 (FIG. 5) of the printing press.

In all the cases illustrated in FIGS. 7A–D, respectively, the controller starts the monitoring process in response to the sheet-feeding signal 76. When the sheet feeder 72 of the printing press begins feeding sheets into the printing press, the sheet-feeding signal is turned on, i.e., switched from a low (zero) state to a high (one) state at time T0. This switching triggers the controller 52 to start monitoring the temperature readings of the sensor 50 as represented by the digital numbers it receives from the I/O device 60. Since it takes sometime for the sheet feeder to load the sheets and for the leading edge of the first sheet to travel to the detection zone of the sensor, the controller expects a time delay, such as 30 seconds or less, before it sees the first sheet. During this period, the sensor detects a relatively low temperature.

Figure 7A:
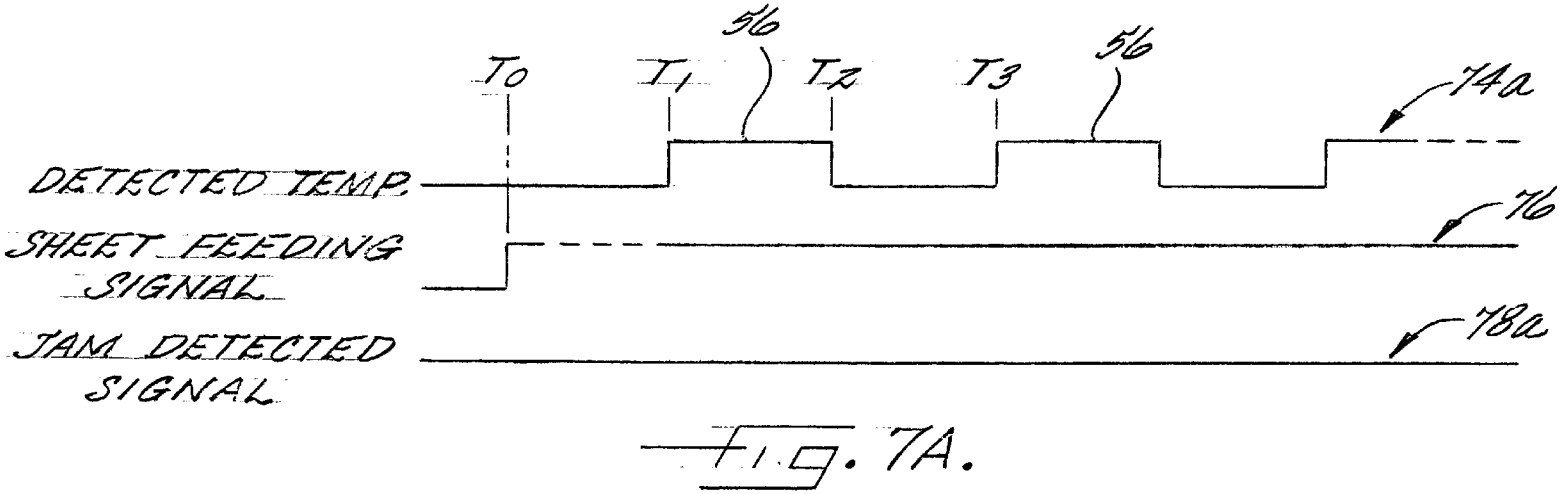
FIG. 7A is a schematic diagram showing a detected temperature curve and related control signals for a normal operation of the printing press.

To determine whether a printing sheet has reached the sensor, the controller 52 looks for a pulse in the output signal of the sensor 50. In this regard, the controller determines there is a pulse when the digital temperature reading it receives from the I/O device 60 has increased from the previous temperature reading by at least a pre-selected step. The size of this step is selected based on various factors such as the sensitivity of the sensor, the conversion ratio between the analog amperage sensor signal and the digital temperature reading, the average difference between the temperature of a printing sheet and the temperature detected by the sensor when there is no sheet, etc. As illustrated in FIG. 7A, the leading edge of the first sheet arrives at time T1, and the detected temperature curve 74*a* jumps up by a step. As a result, the controller detects a pulse in the temperature. The detected temperature remains high for a period of time, such as about 5 seconds or less, until the trailing edge of the sheet passes the detection zone of the sensor at T2. The detected temperature drops to the relatively low level until the leading edge of the second sheet arrives at T3. In the normal operation, this pattern of rise and fall of the detected temperature is repeated as the sheets pass through the detection zone of the sensor one after the other, resulting in a train of pulses.

Figure 7B:
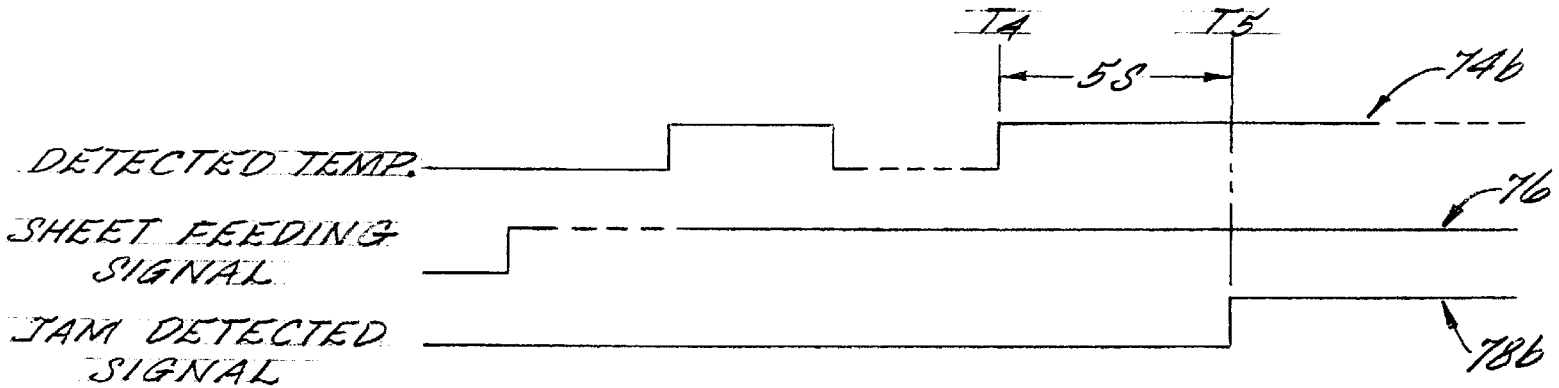
FIGS. 7B–D are schematic diagrams corresponding to three different sheet jamming scenarios and each showing a detected temperature curve and related control signals.

By monitoring the regularity of the pulses 56, the controller is able to determine whether the flow of the sheets has been interrupted. Specifically, the controller monitors whether the detected temperature stays in the high level or the low level for too long. Either of these cases is an indication that the sheet transfer has been interrupted. As to the first case, each sheet is expected to take a certain amount of time to pass by the sensor, and the detected temperature should drop once the sheet has gone through. If, as illustrated in FIG. 7B, the detected temperature curve 74*b* turns high at T4 and stays high for longer than a threshold time period, such as 5 seconds, the sheet is apparently jammed while being in the detection zone of the sensor. In response, the controller switches the level of a Jam Detection signal 78*b* from low to high at T5, to indicate that a jam has been detected. This Jam Detection signal may be used to control the interstation dryer units, such as to shut off the infrared lamps and shut down the press.

Figure 7C:
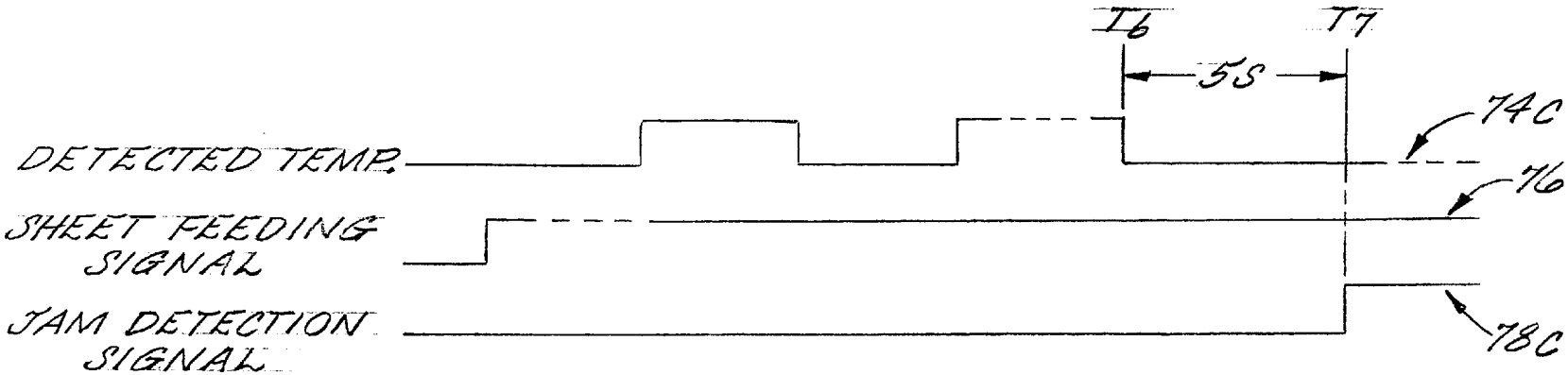

A jam may also happen when the sensor is looking at the space between two sheets. In that case, as illustrated in FIG. 7C, the detected temperature curve 74*c* falls to a relatively low level at T6 and stays at that level longer than a pre-selected threshold time, such as 5 second, that is longer then the normal time it takes for the space between two consecutive sheets to pass the sensor. In response, the controller switches the Jam Detected signal 78*c* to high at T7 to indicate a jam has been detected.

Figure 7D:
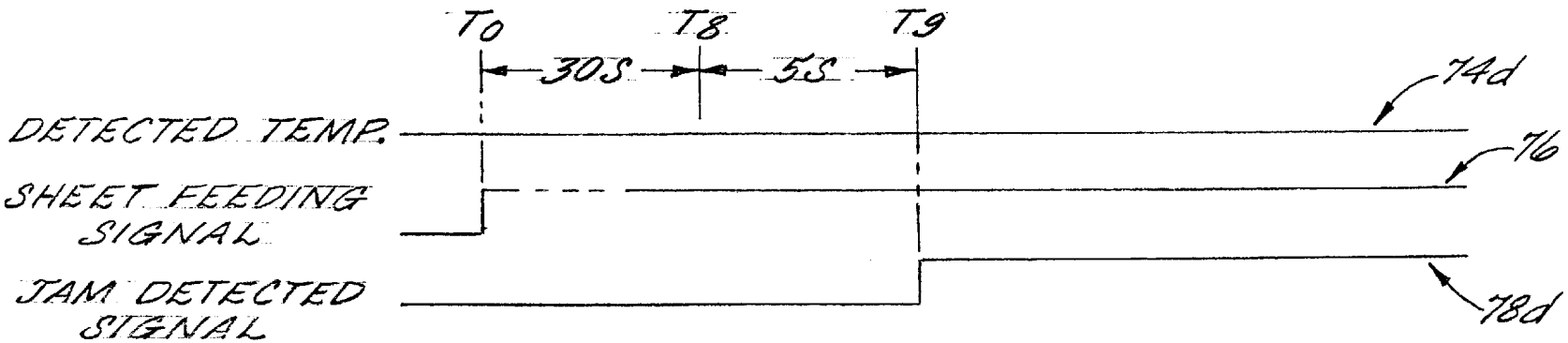

In another scenario, the controller detects that the sheets are not being fed into the printing press. As illustrated in FIG. 7D, after the sheet-feeding signal 76 is switched to high at T0, the controller monitors the detected temperature and expects to see a jump in the temperature reading when the leading edge of the first sheet reaches the detection zone of the sensor within a pre-selected delay period. The delay period, such as 30 seconds, is selected to be longer than the time it normally takes for the sheet feeder to load the first sheet into the printing press. If, however, the detected temperature curve 78*d* remains at the low level for longer than a time threshold, such as 5 seconds, after the delay period has expired at T8, either the sheet feeder has failed to load the first sheet into the printing press or the first sheet is jammed before it reaches the detection zone of the sensor. In response, the controller switches the Jam Detected signal to high at T9 to indicate the detection of a jam.

Figure 8:
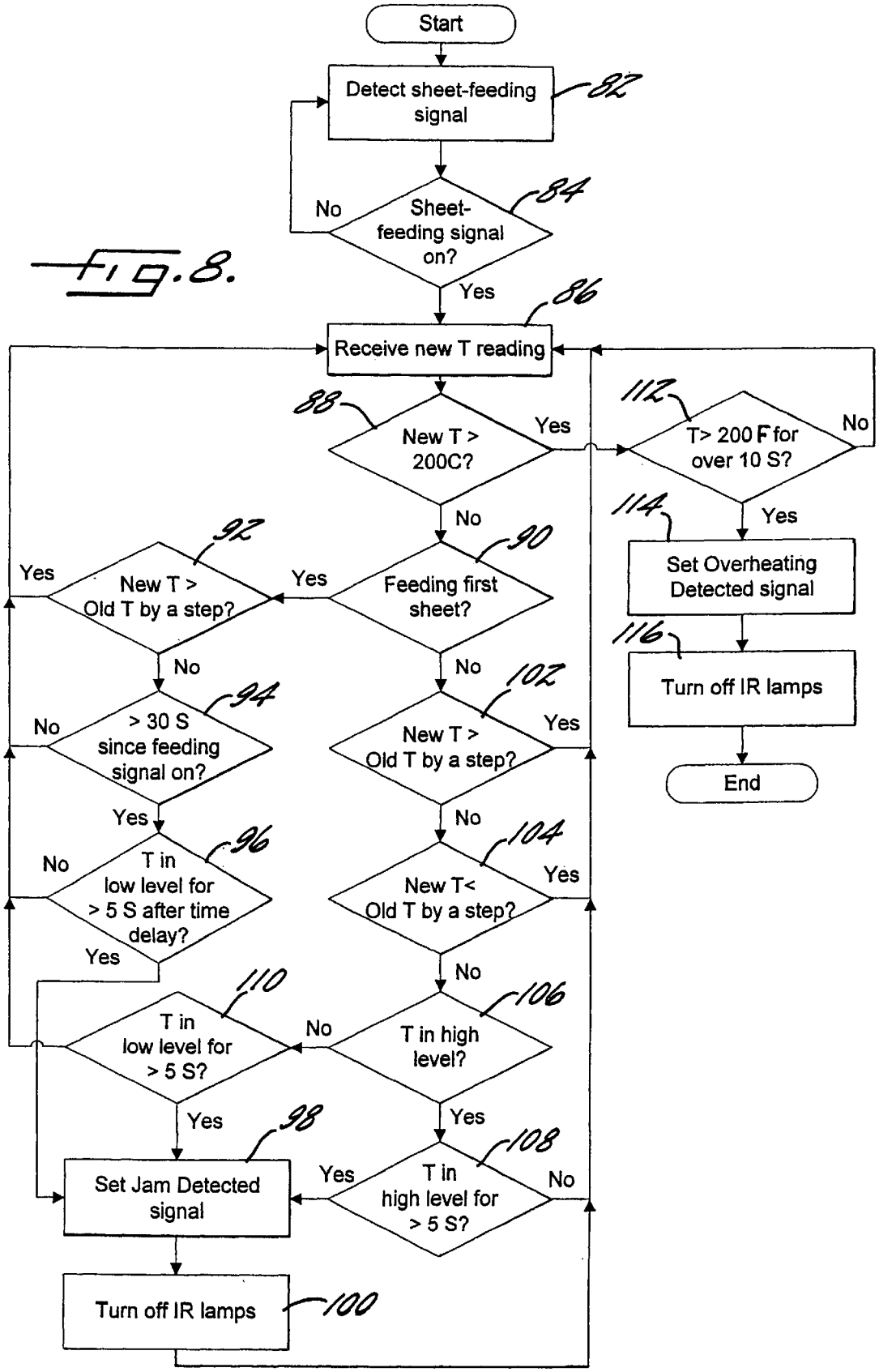
FIG. 8 is a flow chart for a process performed by the safety system for detecting overheating and sheet jamming conditions of the printing press.

The process performed by the controller in the embodiment of FIG. 5 for detecting overheating and sheet jamming is summarized with reference to FIG. 8. At the beginning of the printing operation, the controller monitors the sheet-feeding signal (step 82) and determines whether the sheet feeder has started to feed sheets into the printing press as indicated by the sheet-feeding signal being turned on (Step 84). After the sheet-feeding signal is turned on, the controller receives a new reading of the temperature detected by the sensor from the I/O device (step 86). The new reading is provided to the controller periodically, such as every 50 milliseconds. When the controller receives the new reading, it determines whether the detected temperature is above 200° F. (step 88). If so, the controller determines whether the detected temperature has been above 200° F. for over 10 seconds. If so, an overheating condition has been detected, and the controller turns on the Overheating Detected signal (step 114). In response, the driver control module turns off the infrared lamps.

If the new temperature reading is below 200° F., the controller determines whether the printing process has just started and the first sheet is being fed so that as of the previous temperature reading the sensor has not yet generated a pulse corresponding to the first printing sheet (step 90). If so, the controller checks whether there is a jump in the new temperature reading indicating that the first sheet has reached the temperature sensor (step 92). If no such jump is seen, the controller checks whether it has been more than 30 seconds since the sheet-feeding signal was turned on (step 94). If so, the controller checks whether it has been more than 5 seconds since the 30-second delay period has expired (step 96). If so, a sheet jammed condition is detected, and the controller turns the Jam Detected signal on (step 98). As a result, the infrared lamps are turned off.

If the printing process is not at the beginning stage and the sensor has seen one or more sheets, the controller compares the new temperature reading with the previous reading to see whether temperature has jumped up by a step (step 102) or dropped by a step (step 104). Either a jump or a drop indicates that the printed sheets are moving, i.e., there is no jam. If, however, the new temperature does not differ from the previous reading by a step in either direction, the controller determines whether the temperature is in the high level (step 106) and, if so, whether the temperature has been in the high level for more than 5 seconds (step 108). If so, a jam is detected and the controller turns on the Jam Detected signal (step 98). Similarly, if the detected temperature has been in the low level for more than 5 seconds (step 110), a jam is detected and the controller turns on the Jam Detected signal.

From the foregoing, it can be seen that the safety system of the present invention more reliably guards against overheating and fire hazards associated with high operating temperatures of infrared dryers in printing presses. The safety system is relatively simple in construction and operation by sensing both the interruption of sheet flow and associated fire hazards by directly sensing and monitoring the temperature of passing sheet material by means of a unitary sensor.

What is claimed is:

1. A printing press having a safety system comprising:

a printing unit for applying a printing substance on a substrate material;

an infrared dryer unit having at least one infrared element which transmits infrared radiation for drying the printing substance on the substrate material;

a sheet transfer system for moving sheets in a direction of travel through said printing unit and past said infrared dryer unit in spaced apart relation to each other in the direction of travel;

a temperature sensor arranged to detect directly the temperature of the moving sheets and to generate an output signal containing a pulse for each moving sheet proportionate to the detected temperature of said each moving sheet; and a controller coupled to the temperature sensor for monitoring the output signal of the temperature sensor and responsive to a failure of the sensor to generate pulses for a predetermined time for providing a control signal indicating detection of an interruption in sheet flow through the printing press.

2. A printing press as in claim 1, wherein the temperature sensor is mounted at a downstream end of the infrared dryer unit and oriented for sensing the temperature of each moving sheet exiting the infrared dryer unit.

3. A printing press as in claim 2, wherein the infrared dryer unit has a cabinet, and wherein the temperature sensor is mounted on a support bracket of the cabinet and below a level of the moving sheets.

4. A printing press as in claim 1, wherein the output signal generated by the temperature sensor is an amperage signal.

5. A printing press as in claim 4, further including an input/output device coupled to the controller and disposed to receive the amperage signal generated by the temperature sensor and to convert the amperage signal into digital temperature readings for analysis by the controller.

6. A printing press as in claim 1, wherein the controller is further responsive to the sensor detecting temperature over a predetermined temperature threshold for a predetermined time for providing a second control signal indicating detection of an overheating condition.

7. A printing press having a safety system comprising:

a printing unit for applying a printing substance on a substrate material;

an infrared dryer unit having at least one infrared element which transmits infrared radiation for drying the printing substance on the substrate material;

a sheet transfer system for moving sheets in a direction of travel through said printing unit and past said infrared dryer unit in spaced apart relation to each other in the direction of travel;

a temperature sensor arranged to detect directly the temperature of the moving sheets and to generate an output signal containing a pulse for each moving sheet proportionate to the detected temperature of said each moving sheet; and a controller coupled to the temperature sensor for monitoring the output signal of the temperature sensor and responsive to the sensor detecting temperature above a predetermined temperature threshold for a predetermined time for providing a control signal indicating detection of an overheating condition.

8. A printing press as in claim 7, wherein the temperature sensor is mounted at a downstream end of the infrared dryer unit and oriented for sensing the temperature of each moving sheet exiting the infrared dryer unit.

9. A printing press as in claim 8, wherein the infrared dryer unit has a cabinet, and wherein the temperature sensor is mounted on a support bracket of the cabinet and below a level of the moving sheets.

10. A printing press as in claim 7, wherein the output signal generated by the temperature sensor is an amperage signal.

11. A printing press as in claim 10, further including an input/output device coupled to the controller and disposed to receive the amperage signal generated by the temperature sensor and to convert the amperage signal into digital temperature readings for analysis by the controller.

12. A printing press as in claim 7, wherein the controller is further responsive to a failure of the sensor to generate pulses for a predetermined time for providing a second control signal indicating detection of an interruption in sheet flow through the printing press.

13. A method of detecting an interruption in sheet flow in a printing press having an infrared dryer and a transfer system for moving sheets in a direction of travel through said printing press and past said infrared dryer unit in spaced apart relation to each other, comprising the steps of:

providing a temperature sensor arranged to detect directly the temperature of the moving sheets and to generate an output signal containing a pulse for each moving sheet proportionate to the detected temperature of said each moving sheet; and monitoring the output signal of the temperature sensor;

identifying a failure of the sensor to generate pulses for a predetermined time, and providing a control signal indicating detection of an interruption in the sheet flow.

14. A method as in claim 13, wherein the step of monitoring includes converting the output signal of the temperature sensor into digital temperature readings for computerized analysis.

15. A method as in claim 13, further including turning off the infrared dryer unit in response to the control signal.

16. A method of detecting overheating in a printing press having an infrared dryer and a transfer system for moving sheets in a direction of travel through said printing press and past said infrared dryer unit in spaced apart relation to each other, comprising the steps of:

providing a temperature sensor arranged to detect directly the temperature of the moving sheets and to generate an output signal containing a pulse for each moving sheet proportionate to the detected temperature of said each moving sheet; and monitoring the output signal of the temperature sensor;

determining that the sensor has detected temperature above a predetermined temperature threshold for a predetermined time, and providing a control signal indicating detection of an overheating condition.

17. A method as in claim 16, wherein the step of monitoring includes converting the output signal of the temperature sensor into digital temperature readings for computerized analysis.

18. A method as in claim 17, further including turning off the infrared dryer unit in response to the control signal.

* * * * *